US005497598A

United States Patent [19]

Boldrini

[11] Patent Number: 5,497,598

[45] Date of Patent: Mar. 12, 1996

[54] EQUIPMENT FOR THE APPLICATION OF SEAL LABELS TO CONTAINERS

[75] Inventor: Fulvio Boldrini, Ferrara, Italy

[73] Assignee: G. D S.p.A., Bologna, Italy

[21] Appl. No.: 346,916

[22] Filed: Nov. 23, 1994

[30] Foreign Application Priority Data

Nov. 24, 1993 [IT] Italy ..... B093A0470

[51] Int. Cl.[6] ..... B65B 61/00

[52] U.S. Cl. ..... 53/136.1; 53/234; 156/567

[58] Field of Search ..... 53/135.1, 136.1, 53/136.3, 136.4, 234, 580; 156/567, 568, 572, DIG. 26, DIG. 27, DIG. 31

[56] References Cited

U.S. PATENT DOCUMENTS

| | | | |
|---|---|---|---|
| 4,620,891 | 11/1986 | Applegate et al. | 53/136.1 |
| 4,655,871 | 4/1987 | Mattei et al. | 53/136.1 |
| 4,718,216 | 1/1988 | Focke et al. | 53/234 |
| 5,084,127 | 1/1992 | Nakamura | 53/136.1 |
| 5,146,728 | 9/1992 | Knecht et al. | 53/136.1 |
| 5,159,798 | 11/1992 | Hannon | 53/135.1 |

FOREIGN PATENT DOCUMENTS

| | | | |
|---|---|---|---|
| 0563944 | 10/1993 | European Pat. Off. | B65C 1/04 |
| 2223734 | 4/1990 | United Kingdom | B65C 1/04 |

*Primary Examiner*—John Sipos
*Assistant Examiner*—Ed Tolan
*Attorney, Agent, or Firm*—Cushman Darby & Cushman

[57] ABSTRACT

Seal labels are affixed to containers by means of equipment comprising a system of conveyors serving to direct a succession of the containers along a predetermined path, and a feed device by which gummed labels are supplied to a fixing station occupying a position alongside one part of the selfsame path. The feed device affords a recess located between two points against which the two ends of each label are restrained, and operates in conjunction with a first push rod by which each container in turn is displaced from the conveying path, directed forcibly against a relative label supported by the device and caused to penetrate the recess to a given depth together with the label. Thereafter, the container is ejected from the recess and repositioned on the conveying path by a second push rod.

4 Claims, 5 Drawing Sheets

EQUIPMENT FOR THE APPLICATION OF SEAL LABELS TO CONTAINERS

BACKGROUND OF THE INVENTION

The present invention relates to equipment for the application of seal labels to containers. In particular, the present invention relates to labelling equipment suitable for use in affixing a revenue stamp to the topmost portion of a packet of cigarettes.

U.S. Pat. No. 4,718,216 discloses an item of equipment designed to operate in conjunction with a cigarette packaging machine utilizing two wrapping lines, in which the packets of cigarettes turned out by each line are formed progressively into a vertical stack by an elevator driven intermittently with a push-up type feed action and stationed next to a relative labelling device.

Each such device essentially comprises a suction roller by which the labels are conveyed singly and in succession, held tightly against the peripheral face, first toward a gumming device and then to a station at which each one is affixed to the bottom packet of the stack formed by the elevator.

The periphery of each suction roller is furnished with a plurality of fork elements capable of radial movement in relation to the roller and able also, by means of suction and employing the tips of the relative prongs, to restrain single labels on which a coating of adhesive material has been deposited. In the process of affixing a label to a packet at the bottom of the relative stack, the packets above are elevated from the object packet by a distance such as will allow one fork element of the roller to engage the top of the packet between its prongs. Consequently, before a successive packet can be brought into the area where the labels are affixed, each packet to receive a label in this manner must be lifted, together with the stacked packets above, by a distance significantly greater than the depth of the single packet as measured in the vertical stacking direction.

This substantial movement also occupies a somewhat lengthy interval of time, in order to safeguard the packets from mechanical stresses that could result in damage, and as a result, significant limitations are placed on the operating speed of the equipment in question, hence also of the packaging machine as a whole.

A further drawback of the equipment as disclosed in U.S. Pat. No. 4,718,21 derives from the fact that labels are folded over the tops of the packets in a position whereby a central portion of each label is applied to one vertically disposed end face of the packet and the two end flaps of the label are attached to the two opposite and larger horizontally disposed faces. In the course of the label being affixed to the packet, by reason of the considerable distance separating the uppermost face of the packet and the bottom face of the packet immediately above, which has already received a relative label, it happens on occasion that a bottom flap of the label affixed previously can come adrift from the corresponding horizontal face of the packet immediately above and tend toward a position substantially perpendicular to this same face; in this event, when the bottom packet is lifted subsequently as already intimated, the loose part of the label in question can become creased in an irregular fashion, and even crumple up completely.

The object of the present invention is to provide equipment of the type in question, such as will be devoid of the drawbacks briefly described above and reflecting the prior art.

SUMMARY OF THE INVENTION

The stated object is realized in equipment for the application of seal labels to containers, embodied according to the present invention; such equipment comprises means by which to direct a plurality of containers arranged in succession along a conveying path, feed means by which labels are supplied to a fixing station sited in close proximity to a part of the conveying path, also means by which to apply a suitable adhesive material to the labels, the feed means incorporating at least one device such as will restrain two opposite end portions of a respective single label.

Advantageously, the feed means in question are provided with at least one recess coupled with a respective restraint device, and the equipment further comprises first pushing means by which the single container is displaced from the conveying path, directed forcibly against a label supported by the feed means and caused to enter the recess adjacent to the label, at least in part, and second pushing means by which the container is ejected from the recess and returned to its former position on the conveying path.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
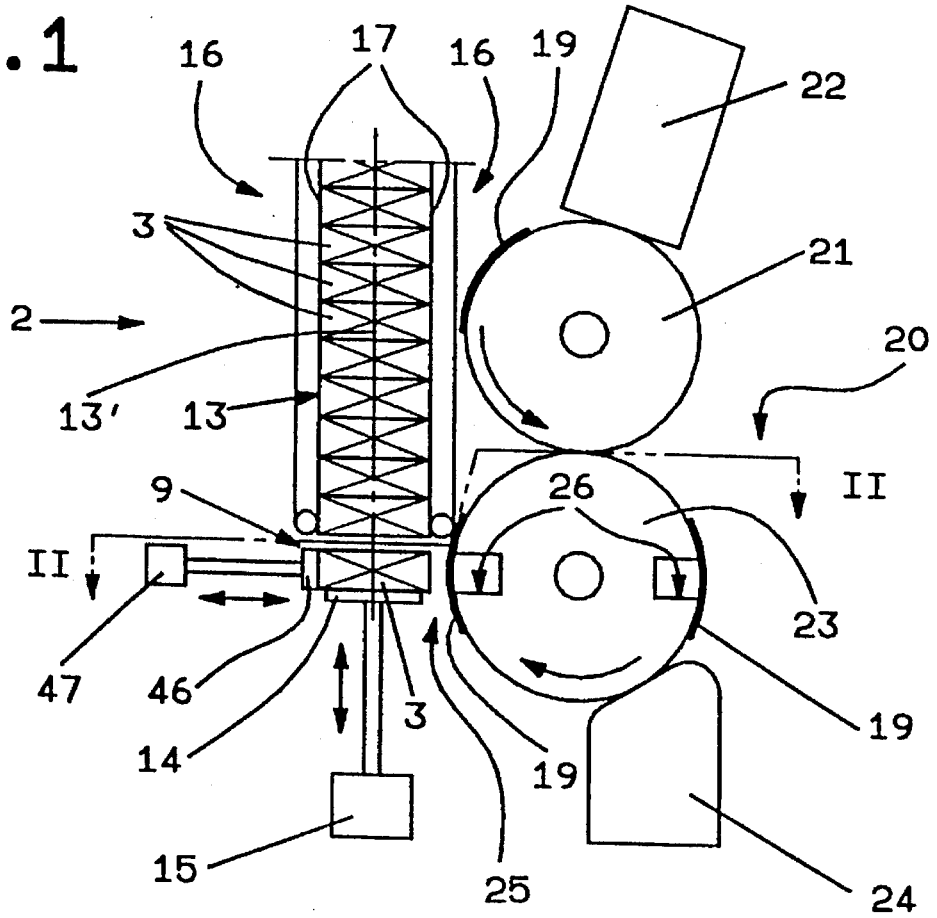
FIG. 1 is a schematic and partial elevation, with parts omitted for greater clarity, of a packaging line incorporating equipment for the application of seal labels to containers, embodied in accordance with the present invention.
Figure 2:
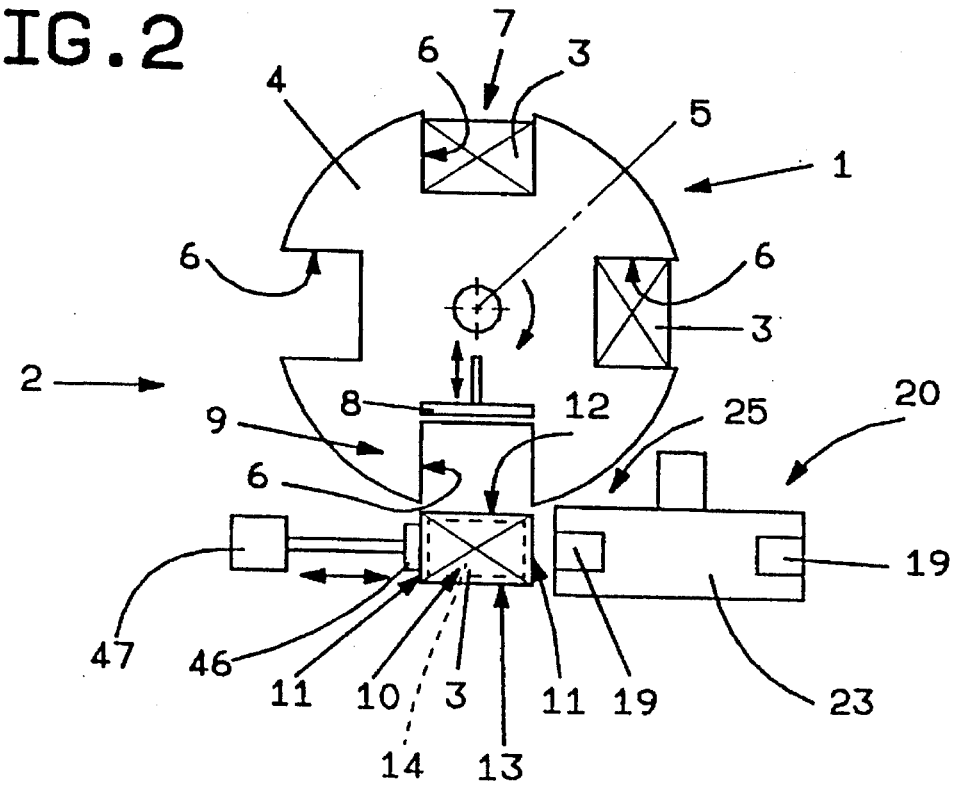
FIG. 2 shows a detail of the packaging line and of the equipment of FIG. 1, viewed in plan.

With reference to FIG. 1 and FIG. 2 of the drawings, 1 denotes the runout station of a conventional packaging line, denoted 2 in its entirety, designed to fashion containers which in the case in point are packets 3 of cigarettes. The runout station 1 consists essentially in a wheel 4 rotatable through discrete steps of constant angular distance (90° in the example indicated) about a vertical axis 5 and affording a plurality of radial slots 6 (four, in the example of the drawings) spaced apart one from the next at identical angular distance around the periphery, each one proportioned to accommodate a respective packet 3 of cigarettes. As the wheel 4 pauses following one step in its rotation, a first packet 3 is directed into a first slot 6 by means operating in conventional manner (not illustrated) at an infeed station 7 located uppermost in FIG. 2; at the same time, a pushing element 8 capable of reciprocating movement along a radial direction, relative to the axis 5 of the wheel 4, and working in conjunction with a reaction element not shown in the drawings, will eject a second packet 3 from a second slot 6 diametrically opposed to the first and occupying an outfeed station denoted 9.

The packet 3 appears substantially parallelepiped in shape, flat and elongated, and the single slot 6 is disposed and shaped to accommodate the packet 3 with the larger faces 10 horizontally disposed and the shorter lateral faces 11 extending vertically and substantially in a radial direction relative to the wheel 4. Thus, the pushing element 8 impinges on one of the two longer lateral faces 12, which, as will become clear, is not destined to receive a seal label of the type referred to in the introductory part of the present specification.

The single packets 3 emerging in succession from the slots 6 of the wheel 4 are placed at the bottom of a vertical stack 13 consisting in a plurality of packets 3 placed one on top of the next with the relative larger faces 10 in mutual contact.

The bottom of the stack 13 lies immediately above an elevator element 14 (FIG. 1) reciprocated in the vertical direction by actuator means, schematically denoted 15, and capable of movement back and forth through a stroke of length marginally greater than the distance separating the two larger faces 10 of the single packet 3.

Figure 3:
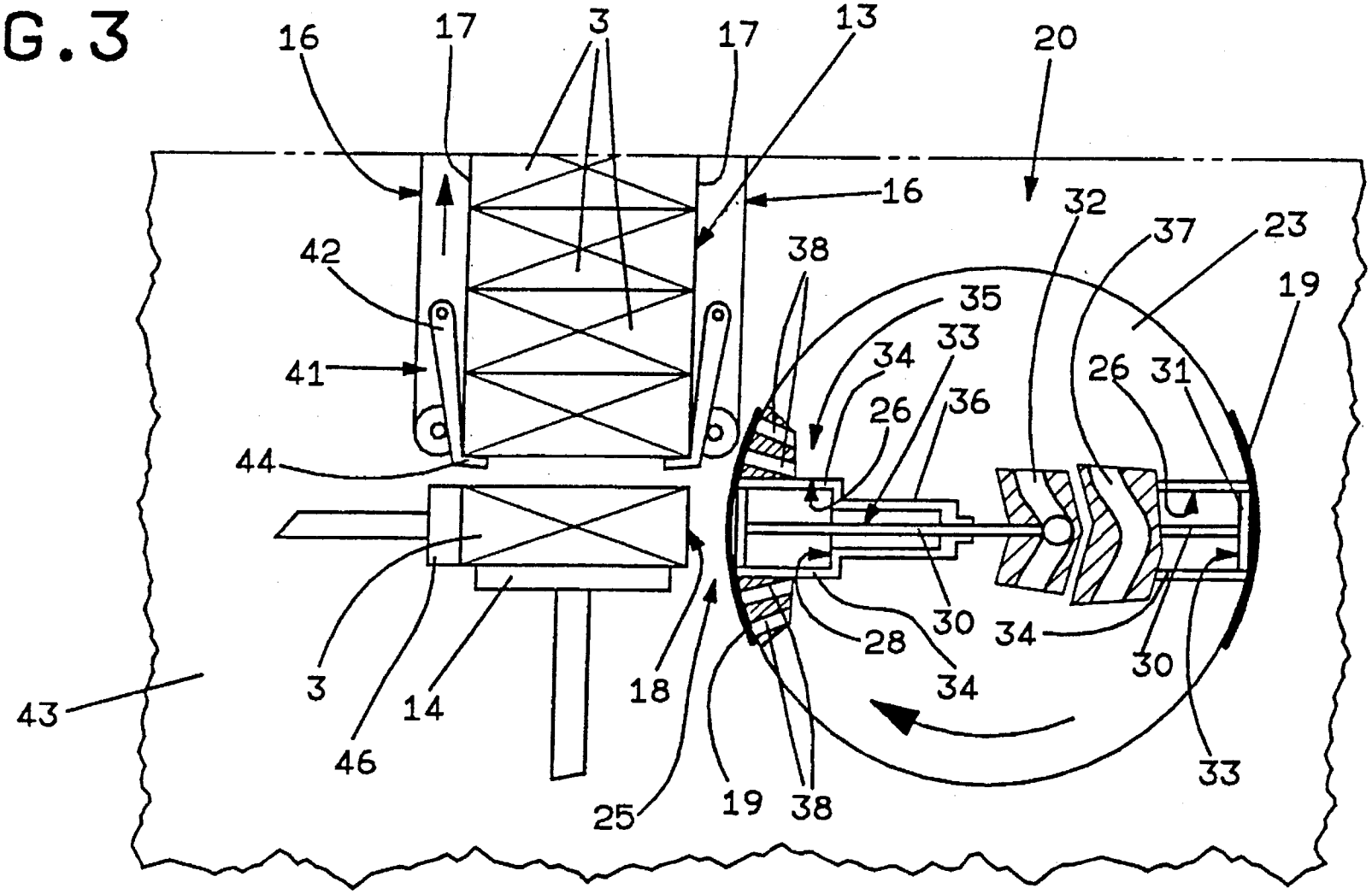
FIGS. 3 to 6 are four enlarged views illustrating selected details of FIGS. 1 and 2 in four different operating conditions.

The part of the stack 13 lying above the outfeed station 9 is compassed laterally on two opposite flanks, in conventional manner, by two vertically disposed conveyor belts 16 of which the respective transport branches 17 are driven intermittently in the upward direction by drive means not illustrated in the drawings. The conveyor belts 16 and elevator element 14 are also referred to collectively herein as means of directing the packets 3 along a given conveying path identifiable, as indicated in FIG. 1, with the longitudinal axis 13' of the stack 13. In the equipment disclosed, labels 19 are supplied to a point 18 immediately alongside one of the two vertically disposed smaller lateral faces 11 of the packet 3 at the very bottom of the stack 13, by a feed device denoted 2 in its entirety (FIG. 3). As discernible in particular from FIG. 1, the feed device 20 comprises a roller 21, rotatable by steps in the anticlockwise direction about a horizontal axis disposed parallel to the path of the packets 3 transferred from the wheel 4 to the stack 13, by which the labels 19 are taken up singly from the bottom of a magazine 22 and held fast by suction, in conventional manner. Thereafter, the labels 19 are released in succession to a further feed device consisting in a roller 23 rotatable by steps about an axis parallel to the axis of the first roller 21 and in the opposite direction; the labels 19 are again held by suction on the face of this second roller 23, and directed in succession against an applicator device of conventional type indicated schematically by the block denoted 24, of which the function is to dispense an adhesive material. The labels 19 are thus coated with a layer of adhesive material and carried further by the roller 23 to a station 25 located immediately alongside the bottom end of the aforementioned stack 13, at which each is affixed to a relative packet 3. In the solution illustrated by way of example, the discrete step completed with each rotation of the two rollers 21 and 23 corresponds to an angle of 180°.

As illustrated to advantage in FIGS. 3 to 6, the periphery of the roller denoted 23 affords two mutually identical and diametrically opposed radial recesses 26. Viewed in section on a plane normal to the axis of the roller 23, the single recess 26 appears substantially rectangular in shape and is compassed (see FIG. 6, in particular) by two side faces 27, disposed parallel both with one another and with a diametral plane of the roller 23, and a bottom face 28 positioned nearer to the axis 29 of rotation of the roller, disposed perpendicular to and interconnecting the side faces 27.

30 denotes a rod passing through the bottom face 28 of each recess 26 in a radial direction, relative to the roller 23, of which the end directed toward the periphery of the roller carries a shoe 31 and the opposite end, located internally of the roller, engages in contact with a cam element 32 (FIG. 3) located likewise internally of the roller 23 and rotatable through the agency of drive means not illustrated in the drawings. Each assembly composed of a shoe 31 and a relative rod 30 constitutes a pushing element 33 capable of recipricating motion along the axis of the rod, as will become clear in due course.

The side faces 27 of each recess 26 are flanked by respective plates 34 constituting the prongs of a fork element 35, which might equally be dispensed with in a simpler embodiment of the roller 23 (not shown). Each pair of plates 34 is connected to a rod 36 (see in particular FIG. 3) disposed radially in relation to the roller 23 and passing through the adjacent bottom face 28, each rod 36 engaging in contact at one end, in a manner not illustrated, with a further cam element 37 located internally of the roller 23 and rotatable through the agency of drive means not illustrated.

The peripheral surface of the roller 23 affords a plurality of holes 38 located adjacent to each of the opposite edges of the recesses 26 and directed substantially toward the axis 29 of the roller 23; these provide suction means serving to retain the labels 19 on the peripheral surface and are caused to connect in a manner not illustrated, by way of conventional valve means denoted 39, with a source of negative pressure 40.

Figure 4:
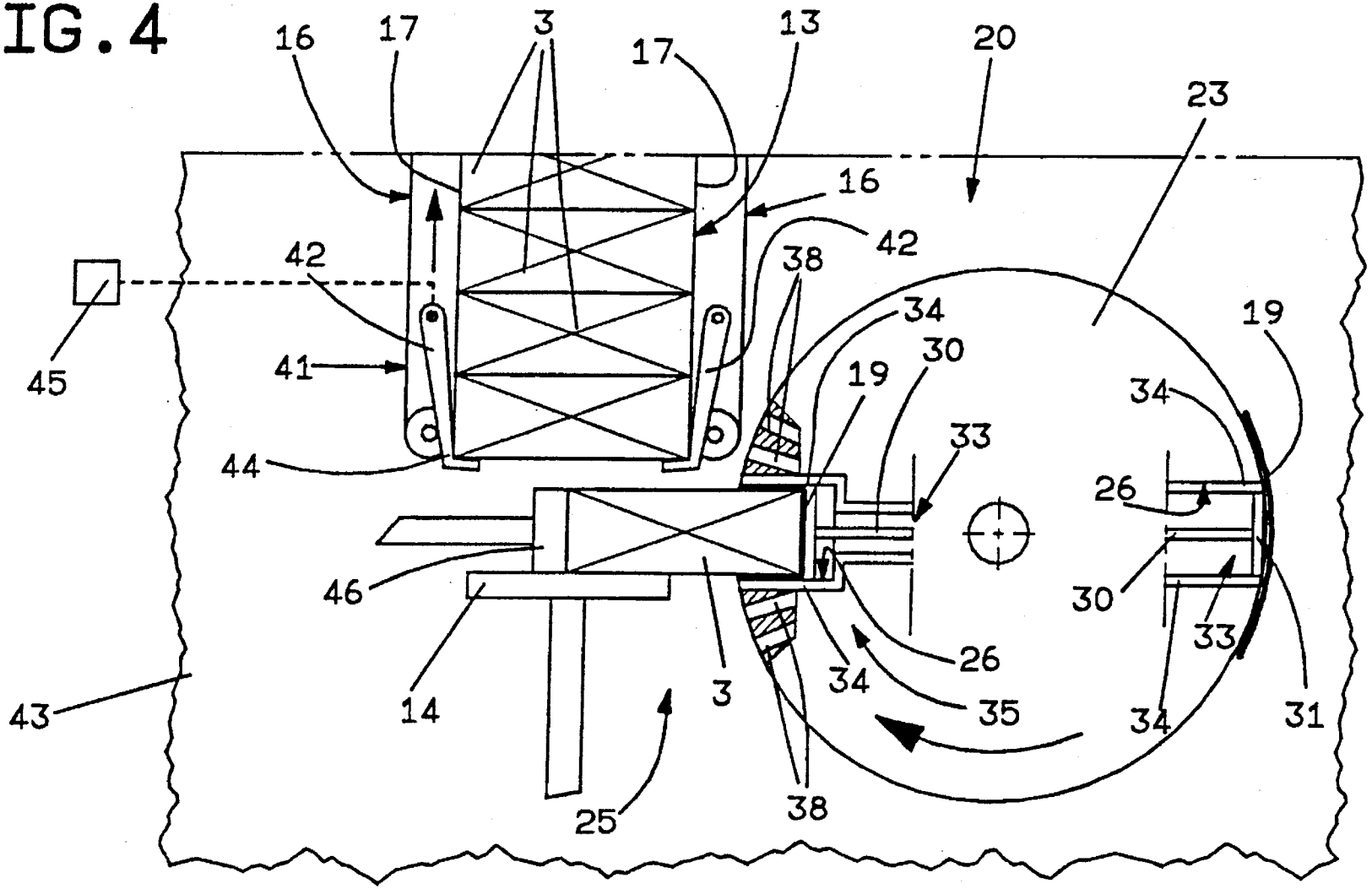

Also illustrated in FIGS. 3 to 6, associated with the lower portion of the two conveyor belts 16, are means denoted 41 by which to position the packets 3 forming part of the stack 13. Such means 41 take the form of a pair of support elements, one to each conveyor belt 16, consisting in two substantially vertical arms 42 of which the top ends are anchored pivotably to a vertical wall 43 integral with the machine bed of the packaging line 1; each arm 42 is rotatable thus about a horizontal axis disposed parallel to the direction followed by a packet 3 during its transfer from the relative slot 6 of the wheel 4 to the bottom of the stack 13. The bottom ends of the arms 42 afford respective appendages 44 converging within a substantially horizontal plane toward the longitudinal axis of the stack 13, of which the horizontal top faces are disposed a short distance above the upwardly oriented faces 10 of the packets 3 occupying the slots 6 of the wheel 4. As shown in FIG. 4, the arms 42 are connected (in a conventional manner not illustrated) to actuator means 45 capable of rotating the two arms 42 about the axes of their fixed pivots in either direction and thus causing the appendages 44 to draw together or spread apart, respectively.

In operation, following each step rotated by the wheel 4, the packet 3 nearest the outfeed station 9 is directed by the pushing element 8 out of the relative slot 6 and onto the elevator element 14, currently in a lowered position. In the course of this transfer, the packets 3 already forming part of the stack 13 will remain sandwiched between the vertical conveyor belts 16 and held motionless, the appendages 44 of the arms 42 locating underneath the bottom packet 3 and preventing any possibility of a collapse.

At this point the roller 23 is at standstill in the configuration of FIG. 3, each recess 26 concealed behind a respective label 19 pinned by the force of suction generated through the holes 38 adjacent to the circumferential edges of the recesses 26. There are thus two labels 19 held in this manner, taken up previously from the bottom of the magazine 22 as aforementioned by the top roller 21 and released to the second roller 23, of which one is positioned at the fixing station 25, its exposed face coated at least in part with a layer of adhesive furnished by the applicator device 24.

The pushing elements 33, interacting with the cam element 32, occupy a position of maximum radial extension in relation to the roller 23 such that the relative shoe 31 rides substantially in contact with the label 19 bridging the recess 26 internally of which the shoe is accommodated. The prongs 34 of the fork element 35 remain accommodated entirely within the recesses 26, controlled by the relative cam element 37, their tips disposed substantially in contact with the respective label 19.

The roller 23 is designed to operate in conjunction with a further pushing element 46 (see FIGS. 1 and 2 in particular) located on the opposite side of the packet 3 occupying the elevator element 14, such as can be reciprocated in a horizontal direction, at right angles to the axis 29 of the roller 23, by an actuator element denoted 47.

Figure 5:
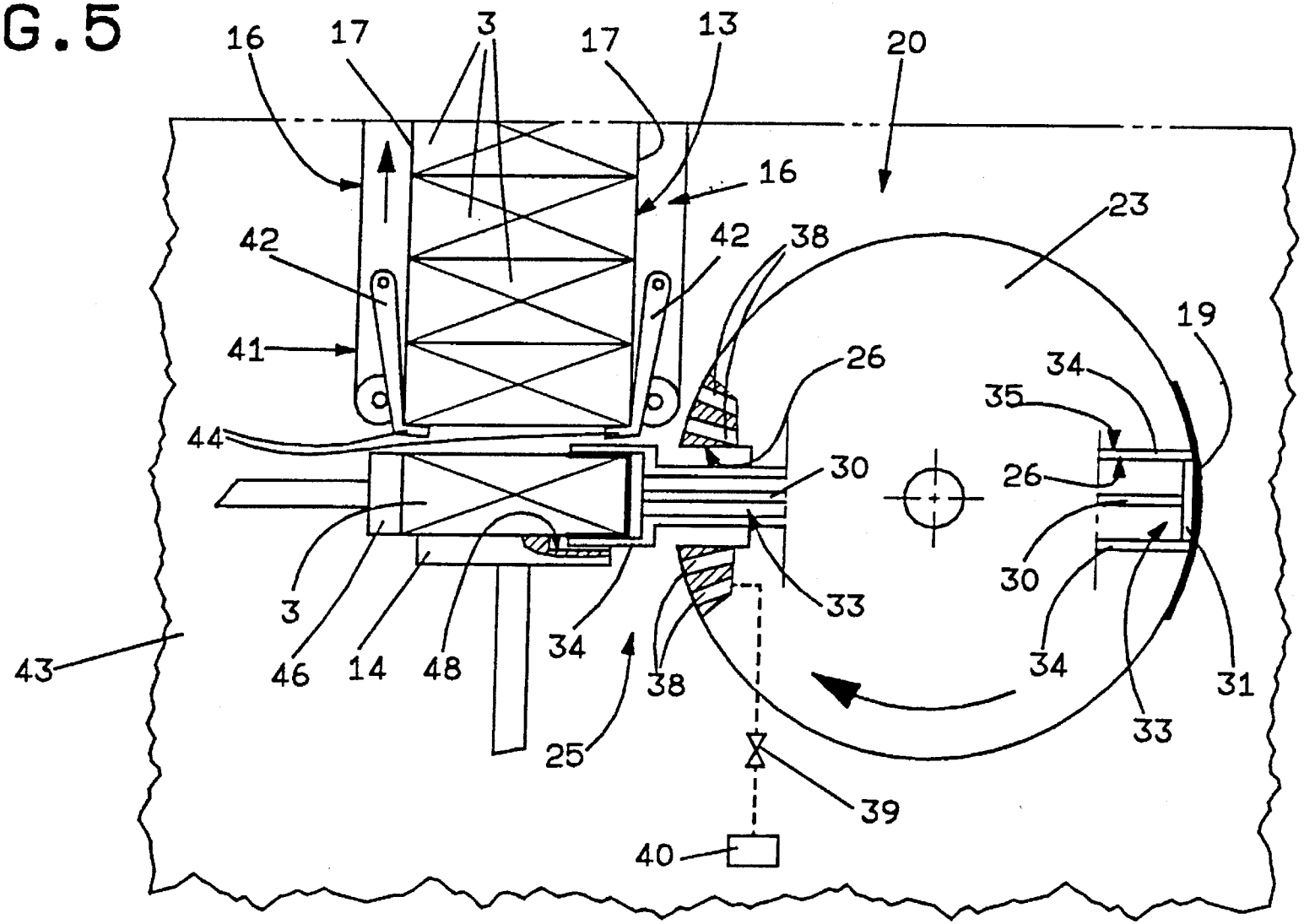
Figure 6:
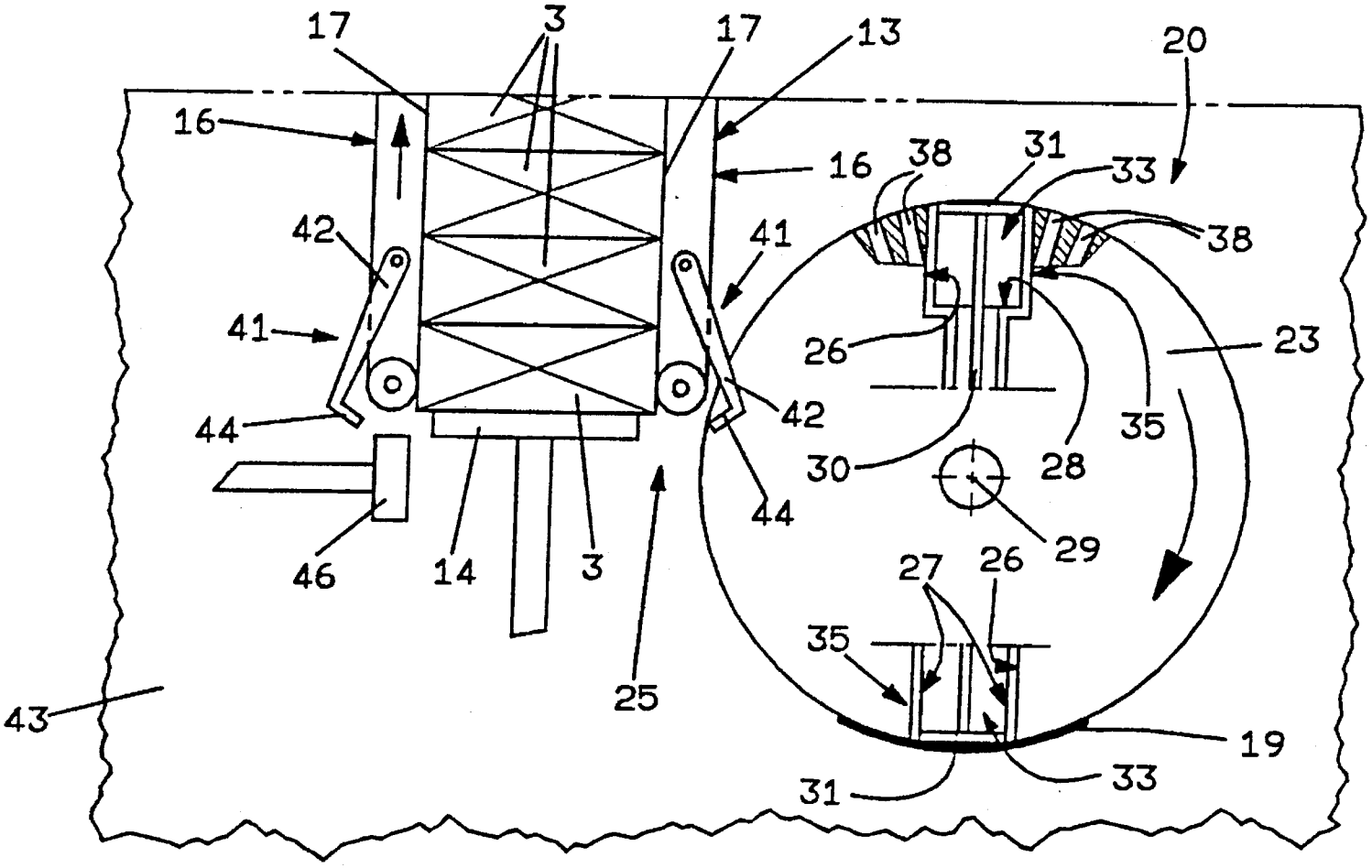

Proceeding from the configuration of the roller 23 thus described, the pushing element 46 will begin to advance the packet 3 supported by the elevator element 14 toward the recess 26 currently alongside the fixing station 25, with the result that the leading end of the packet 3 locates between the prongs 34 of the adjacent fork element 35, its insertion favored by a corresponding retraction of the pushing element denoted 33. In the course of this movement, the leading face 11 of the packet 3 will impinge on a central portion of the label 19 held in position by the roller 23 at the station 25 (FIG. 4) and force it between the prongs 34 of the fork element 35, causing the label 19 itself to fold around the packet into a U shape, sticking to a corresponding portion of the leading face 11 and to respective portions of the two larger faces 10. The moment that the label 19 begins to fold, the aforementioned valve means 39 will disconnect the holes 38 from the source of negative pressure 40. Thereafter, the same pushing elements 46 and 33 and the fork element 35 translate in concert to return the packet 3 to the elevator element 14 (FIG. 5). It will be observed from the illustration of FIG. 5 that as the packet 3 regains its former position, the bottom prong 34 of the fork element 35, or at least the forwardmost tip, locates in an upwardly directed cavity 48 afforded by a lateral portion of the elevator element 14.

The fork element 35 is now returned by the relative cam element 37 to its former position as indicated in FIG. 3, and, the instant that the prongs 34 have disengaged entirely from the faces of the packet 3, the pushing element 33 is returned likewise by the relative cam element 32 to the position of FIG. 3. Accordingly, the function of the fork element 35 is to act as a restraint, following the partial entry of the packet 3 and the relative label 19 into the recess 26, by which the end portions of the newly affixed label 19 are held forcibly in contact with the corresponding faces 10 of the packet 3 for a relatively long duration, sufficient to allow an initial drying of the adhesive substance utilized. The roller 23 now rotates through a further step (FIG. 6), whilst the arms 42 are rotated about their respective pivots to distance the appendages 44 one from another, the conveyor belts 16 are activated momentarily, and the packet 3 is directed by the elevator element 14 between the inner branches 17 of the belts, whereupon the appendages 44 are drawn together to their fully contracted position and the elevator element 14 returns to the previous lowered position as indicated in FIGS. 3, 4 and 5.

The entire sequence of steps described thus far is repeated in affixing a label 19 to each packet 3 transferred from the runout wheel 4 to the elevator element 14.

It will be appreciated as a general principle that the packets 3 might advance either close together or spaced apart in whatever fashion when brought within the operating compass of the roller 23, following any given trajectory, not necessarily rectilinear, and in a direction other than that described and illustrated.

What is claimed:

1. Equipment for applying seal labels to containers, comprising:

a rotatable wheel providing a plurality of radial slots proportioned to accommodate a plurality of containers arranged in respective positions in succession along a conveying path;

means for applying an adhesive material to a succession of seal labels;

a roller providing a recess having opposite edges, a fork element having two prongs, and a plurality of holes connected with a source of negative pressure for restraining two opposite end portions of an adhesive-bearing respective said label, said plurality of holes being located adjacent to each of opposite edges of the recess, said roller being arranged to supply adhesive-bearing labels singly in succession to a fixing station sited in close proximity to a part of the conveying path;

first pushing means for displacing each container singly in succession from a respective said slot of the wheel, for directing said container forcibly against a respective adhesive-bearing label supported by said roller, and causing said container to penetrate the respective adhesive-bearing label, at least, in part, together with the respective label in the respective said recess;

second pushing means mounted within the roller, with said fork element being part of said second pushing means, for ejecting the container from the recess and returning the container to its respective said position on the conveying path and for forcibly holding said container in contact with said end portions of the label while said container is translating in concert with said forks, for a duration sufficient to allow an initial drying of the adhesive material applied on the respective label.

2. The equipment of claim 1, wherein:

said positions on said conveying path are disposed in a single row and said conveying path is substantially rectilinear.

3. The equipment of claim 1, further comprising:

each recess having two opposite faces coinciding respectively with said prongs of said fork element;

means for reciprocating said fork element in a direction normal to apart of said conveying path; and said roller being positioned alongside the prongs of the fork element.

4. The equipment of claim 1, further comprising:

means for positioning and maintaining a given number of said containers from said plurality of containers, at a predetermined distance from said container while said containing occupies said fixing station.

* * * * *